US006446465B1

(12) United States Patent
Dubar

(10) Patent No.: US 6,446,465 B1
(45) Date of Patent: Sep. 10, 2002

(54) LIQUEFACTION PROCESS AND APPARATUS

(75) Inventor: Christopher A. T. Dubar, Beaumaris (AU)

(73) Assignee: BHP Petroleum PTY, Ltd., Melbourne (AU)

( * ) Notice: Subject to any disclaimer, the term of this patent is extended or adjusted under 35 U.S.C. 154(b) by 0 days.

(21) Appl. No.: 09/951,725

(22) Filed: Sep. 14, 2001

Related U.S. Application Data

(63) Continuation of application No. 09/581,341, filed on Aug. 21, 2000.

(30) Foreign Application Priority Data

Dec. 11, 1997 (GB) ..... 9726297

(51) Int. Cl.[7] ..... F25J 1/00
(52) U.S. Cl. ..... 62/613; 62/612
(58) Field of Search ..... 62/611, 612, 613

(56) References Cited

U.S. PATENT DOCUMENTS 4,539,028 A * 9/1985 Paradowski et al. ..... 62/613
4,680,041 A * 7/1987 DeLong ..... 62/611
4,911,741 A * 3/1990 Davis et al. ..... 62/612
5,473,900 A * 12/1995 Low ..... 62/612
5,611,216 A * 3/1997 Low et al. ..... 62/612
5,826,444 A * 10/1998 Capron et al. ..... 62/612
6,016,665 A * 1/2000 Cole et al. ..... 62/612

FOREIGN PATENT DOCUMENTS

EP 131947 A2 * 7/1984
WO WO95/27179 A1 * 10/1995
WO WO97/13108 A1 * 4/1997
WO WO97/33131 A1 * 9/1997

* cited by examiner

*Primary Examiner*—William C. Doerrler
(74) *Attorney, Agent, or Firm*—Dykema Gossett PLLC

(57) ABSTRACT

Apparatus for liquefying natural gas, comprising a series of heat exchangers for cooling the natural gas in countercurrent heat exchange relationship with a refrigerant, compression means for compressing the refrigerant, expansion means for isentropically expanding at least two separate streams of the compressed refrigerant, said expanded streams of refrigerant communicating with a cool end of a respective one of the heat exchangers, and a precooling refrigeration system for precooling the natural gas to a temperature below 0° C. before it is fed to the series of heat exchangers, and for precooling the compressed refrigerant discharged from a warm end of the series of heat exchangers to a temperature below 0° C. before it is fed back into the series of heat exchangers or to the expansion means.

17 Claims, 4 Drawing Sheets

LIQUEFACTION PROCESS AND APPARATUS

CROSS-REFERENCE TO RELATED APPLICATIONS

This application is a continuation of application Ser. No. 09/581,341, filed Aug. 21, 2000, now abandoned, which was a U.S. national phase of PCT/GB98/03708, filed Dec. 11, 1998.

BACKGROUND OF THE INVENTION

This invention relates to a liquefaction process and apparatus.

In the liquefaction of natural gas with a refrigerant it is known to try to match the natural gas cooling curve with the refrigerant warning curve by splitting the refrigerant into two streams which are cooled to different temperatures. This is described, for example, in ore WO-A-9527179.

In our WO-A-9713108 there is disclosed a compact LNG plant for use in the offshore liquefaction of natural gas. FIG. 1 of the attached drawings illustrates a natural gas liquefaction apparatus of the general type disclosed in WO-A-9713108, although there are differences between FIG. 1 and the disclosure of WO-A-9713108.

In FIG. 1 pretreated natural gas is fed via a conduit 101 to a heat exchanger 166 at a pressure of about 8.3 MPa. In one example, the natural gas in conduit 101 would have the following composition: 4.2 mol% nitrogen; 85.1 mol% methane; 8.2 mol% ethane; and 2.5 mol% propane. The natural gas in the conduit 101 is cooled to a temperature in the range about 5° C. to 10° C. by heat exchange with chilled water, and is discharged into a conduit 102.

The natural gas exiting the heat exchanger 166 is fed to the warm end of a CWHE (coil wound heat exchanger) 150 via the conduit 102. The CWHB 150 comprises a single shell, which houses two separate heat exchanger bundles 151 and 152. The natural gas is cooled in the CWHE 150 by countercurrent heat exchange with a nitrogen refrigerant. The cooled natural gas leaves the CWHE 150 at a temperature around −90° C., and is fed to a farther heat exchanger 153 via a conduit 104. the heat exchanger 153 may be an aluminum PFHE (platefin heat exchanger). The natural gas is cooled to a temperature of about −150° C. in the heat exchanger 153, and exits the cool end of the exchanger 153 into a conduit 106.

The natural gas in conduit 106 is fed to the warm end of a heat exchanger 154, in which it is cooled to a temperature of about −160° C., and it exits the cool end of the exchanger 154 into a conduit 107. The natural gas in conduit 107 is fed to the top of a nitrogen stripper column 157. The column 157 is needed when the nitrogen content of the feed gas is high and the required composition of the LNG product cannot be achieved using one or two stages of flash separation drums. The stripping process is assisted by using the exchanger 154 to provide reboil heat transferred fro the natural gas in conduit 106. LNG is fed from the column 157 to a conduit 167, tom where the LNG is fed to the cool end of the exchanger 154. The exchanger 154 warms the LNG to a temperature of about −160° C.; the LNG exits the warm end of the exchanger 154 into a conduit 168, through which it is fed back to the column 157.

LNG is fed from the bottom of the column 157 to a conduit 111 and then to a transfer pump 158. The pump 158 pumps the LNG into a conduit 112 and on to a LNG storage tank 186.

The flash gas, which contains methane and a high proportion of nitrogen, exits from the top end of the column 157 to a conduit 109. The flash gas in conduit 109, which is at a temperature of about −167° C., is fed to the cool end of a heat exchanger 155, in which the gas is warmed to a temperature of about −40° C. The warmed gas is fed from the warm end of the exchanger 155 to a conduit 110, from which it is fed to a multistage fuel gas compressor 180. The compressor 180 has at least four stages of compression with intercooling between each stage using cooling water. The flash gas is compressed in the compressor 180 from just above atmospheric pressure to a pressure which is typically in the range 2.7 to 5.5 MPa, and is then fed to a turbine 173 of a refrigerant compressor 159, as described in more detail below. High fuel gas pressures are required when the turbine is an aeroderivative turbine, owing to the high compression ratios used in such turbines. The fuel gas compressor 180 thus has a significant power requirement, owing to the high discharge pressure and high nitroen content of the gas, such that a gas turbine drive is usually used from economic considerations, rather than an electric motor drive. As described below, the flash gas fed through the conduit 110 is used to provide the bulk of the fuel gas requirements of the liquefaction plant.

The nitrogen refrigeration cycle which cools the natural gas to a temperature at which it can liqueur will now be described. Nitrogen refrigerant is discharged from the warm end of the CWHE 150 into a conduit 132 at a temperature of about 5° C. The nitrogen is fed to a multistage compressor unit 159, which comprises at least two compressor stages 169 and 170, with at least one intercooler 171, and an aftercooler 172. The compressor stages 169 and 170 are driven by a gas turbine 173. The operation of the compressor unit 159 consumes almost all of the power required by the nitrogen refrigeration cycle. The gas turbine 173 is driven by the fuel gas derived from conduit 110.

The compressed nitrogen is discharged from the compressor unit 159 into a conduit 133 at a pressure of about 5.1 MPa. The conduit 133 leads to two conduits 134 and 135 between which the nitrogen from the conduit 133 is split according to the power absorbed by the compressor. The nitrogen in the conduit 134 is fed to a compressor 162 in which it is compressed to a pressure of about 8.5 MPa, and is then fed from the compressor 162 to a conduit 136. The nitrogen in the conduit 135 is fed to a compressor 163 in which it is compressed to a pressure of about 8.5. MPa, and is then fed from the compressor 163 to a conduit 137. The nitrogen in both the conduits 136 and 137 is fed to a conduit 138 and then to a heat exchanger 164, where it is cooled to ambient temperatures. The nitrogen is fed from the heat exchanger 164 through a conduit 139 to a heat exchanger 165 in which it is cooled to a temperature of 5° C. to 10° C. by chilled water. The cooled nitrogen is fed from the exchanger 165 to a conduit 140, which leads to two conduits 120 and 141. The nitrogen flowing through the conduit 140 is split between the conduits 120 and 141: about 2% of the nitrogen in conduit 140 flows through the conduit 141. art The nitrogen flowing through the conduit 141 is fed to the warm end of the heat exchanger 155, where it is cooled to a temperature of about −123° C. by countercurrent heat exchange with the flash gas from the column 157. The cooled nitroen is discharged from the cool end of the exchanger 155 to a conduit 142.

The conduit 120 is connected to the warm end of the CWHE 150, whereby the nitrogen is fed to the warm end of the heat exchanger bundle 151. The nitrogen from conduit 120 is pre-cooled to about 13° C. in the heat exchanger bundle 151. A majority of the nitrogen refrigerant is withdrawn from the CWHE 150, after passing through the bundle 151, via a conduit 122. The remainder of the nitrogen refrigerant passes through the bundle 152, is cooled to a temperature of about −90° C., and is discharged from the CWHE 150 into a conduit 124.

The nitrogen in the conduit 122 is fed to a turbo expander 160, in which it is work expanded to a pressure of about 1.9 MPa and a temperature of about −95° C. The expanded nitrogen is discharged from the expander 160 into a conduit 128. The nitrogen in the conduit 124 is mixed with the nitrogen in the conduit 142, and is then fed to a turbo expander 161 in which it is work expanded to a pressure of about 1.9 MPa and a coolest nitrogen temperature of about −151° C. The expanded nitrogen is discharged from the expander 161 into a conduit 126. The turbo expander 160 is arranged to drive the compressor 162, and the turbo expander 161 is arranged to drive the compressor 163. In this way the majority of the work produced by the expanders 160 and 161 can be recovered.

The nitrogen in the conduit 126 is fed to the cool end of the heat exchanger 153, and cools the natural gas therein by countercurrent heat exchange. In the heat exchanger 153 the nitrogen is warmed to an intermediate nitrogen temperature of about −95° C. The nitrogen exits the warn end of the heat exchanger 153 and is mixed with the nitrogen in the conduit 128 before being fed to the cool end of the CWHE 150. The nitrogen in the CWHE 150 cools the natural gas therein by countercurrent heat exchange.

The heat exchangers 153, 154 and 155, and the column 157 are arranged within a cold box 181.

Inlet combustion air for the gas turbine 173 is fed to a beat exchanger 182 where it is cooled to 5° C. to 10° C. by heat exchange with chilled water. The combustion air is then discharged into a conduit 183 and is fed to the turbine 173.

Chilling of the inlet air to the gas turbine increases the power output where the ambient air temperature is high.

As in most large scale LNG plants, the most expensive items of equipment are the gas turbine drives and compressors as well as the main CWHE cooling exchangers, such as the bundles 151 and 152 which are normally made of aluminum.

It is an object of the present invention to improve the efficiency and lower the capital cost of prior art processes for liquefying natural gas.

SUMMARY OF THE INVENTION

BACKGROUND OF THE INVENTION

The present invention relates to a method and apparatus for liquefying natural gas, comprising a series of heat exchangers for cooling the natural gas in countercurrent heat exchange relationship with a refrigerant, compression means for isentropically expanding at least two separate streams of the compressed refrigerant, wherein said expanded streams of refrigerant communicate with a cool end of a respective one of the heat exchangers.

One important aspect of the invention involves the use of a precooling refrigeration system to precool the natural gas to a low temperature below 0° C., before it is fed to the warm end of the series of heat exchangers. The precooling refrigeration system is also used to precool the high pressure refrigerant to a temperature below 0° C. before it is fed to any of the heat exchangers in the series of heat exchangers or to the expansion means. This has been found to reduce significantly power requirements of liquefaction apparatus, and reduce the number of components of the equipment. Advantageously, substantially all the refrigerant in the refrigeration cycle is precooled by the precooling refrigeration system.

It is desirable that the refrigerant in a first of said separate refrigerant streams is cooled in at least one of the series of heat exchangers; this takes place after it has been precooled in the precooling refrigeration system. Furthermore, the use of the precooling refrigeration system makes it unnecessary to cool more than one of the refrigerant streams in the series of beat exchangers, so we prefer that each refrigerant stream other than the first is fed directly to its respective expansion means without farther cooling in the series of heat exchangers.

The refrigerant of the refrigerant streams may be precooled before or after being separated into said streams, although it is more convenient and economical to carry out the precooling before separation. Preferably the refrigerant is split into two refrigerant streams.

We have unexpectedly found that, by using a precooling refrigeration system, it is only necessary to use two heat exchangers in the series of heat exchangers, which is fewer than in WO-A-9527179 and WO-A-9713108, and which leads to significant savings in the cost of manufacturing, operating and maintaining the heat exchangers.

Accordingly, in the preferred embodiment there are two heat exchangers in the series of heat exchangers, the refrigerant is split into first and second refrigerant streams, and only the refrigerant in the first refrigerant stream is cooled in a first, warmest, of said two heat exchangers. Thus, when two refrigerant streams are used, the first refrigerant stream can be fed through the warmest of the heat exchangers in the series of heat exchangers, and the second refrigerant stream can be fed directly to the expansion means without passing through the series of heat exchangers. This allows the heat transfer area in the first heat exchanger to be reduced by about 35% compared with the arrangement shown in FIG. 1, and reduces the complexity of the equipment. This makes it easier to use less expensive types of heat exchanger, such as an aluminum PFHE or a printed circuit heat exchanger (PCHE), instead of a CWHE.

The intercooler 171, shown in FIG. 1, is an expensive piece of equipment because of its high design pressure, large area requirement, and titanium construction used for the parts in contact with sea water cooling medium. With the apparatus of the present invention it is possible to dispense with the intercooler 171 of FIG. 1, because the compressed refrigerant discharged from the compression means is within normal bounds.

Furthermore, the present invention makes it possible to reduce the complexity of the compression means, because the lower refrigerant temperature and, therefore, lower head requirement, allows either a smaller number of compressor wheels or a reduction in wheel diameter; additionally, the number of nozzles required on the compressor case can be reduced from 4 to 2, leading to further cost savings. Another advantage is that the power requirement for the compression means is reduced by about 16% for the same natural gas capacity, which makes it possible to reduce the rating of a turbine used to power the compressor. This makes it possible to replace the two compressor/intercooler arrangement of FIG. 1 with a single compressor stage and no intercooler.

The expanded refrigerant of the first refrigerant stream is preferably fed to a cool end of the second heat exchanger, and the expanded refrigerant of the second refrigerant stream is preferably fed to the cool end of the first heat exchanger. Before being fed to the cool end of the first heat exchanger, the expanded refrigerant of the second refrigerant stream is preferably mixed with the expanded refrigerant of the first refrigerant stream discharged from the warm end of the second heat exchanger.

The two heat exchangers of said series of heat exchangers may be separate, or may be provided in a single heat exchanger shell having two heat exchange bundles therein; each bundle corresponds to one of the heat exchangers of said series of heat exchangers. The use of a single heat exchanger has the advantage that the cold box can be omitted without any significant disadvantageous effects on efficiency.

The natural gas and the refrigerant are preferably precooled in the precooling refrigeration system to a temperature in the range 0° C. to −40° C., preferably −10° C. to −30° C. It is preferred to cool the natural gas and the refrigerant to substantially the same temperature with the precooling refrigeration system. The refrigerant is typically discharged from the warm end of the warmest heat exchanger at a temperature below −20° C.

An industry standard refrigeration system can be used, to precool the nitrogen and natural gas streams in two or more stages. The number of refrigeration stages for the system is selected depending on the final precooling temperature and by optimising the power requirements of the refrigeration system against the increase in cost for the larger number of equipment items.

There is a range of types of heat exchanger that could be used as the precooling heat exchangers For example, the precooling heat exchanger may be of the aluminum core-in-kettle type or an aluminum plate-fin heat exchanger PFHE or a PCHE. However, it is preferred for economic reasons that the precooling heat exchangers are conventional kettle type shell and rube chillers constructed of carbon steel.

The precooling refrigerant system precools both the natural gas and the natural gas refrigerant using a separate precooling refrigerant. The precooling refrigerant may be, for example, propane, propylene, ammonia or a Freon refrigerant. It is preferred that the precooling refrigerant is R410a Freon, because it is relatively safe and environmentally benign with a high capacity.

In the present invention, the precooling refrigerant is advantageously compressed by a single compression unit comprising two or more compressors stages driven by a precooling gas turbine, instead of using a plurality of separate electric motor driven chiller units as in FIG. 1. A two-stage refrigeration system is usually suitable, but in some cases a three or four stage system may be advantageous The reduction in the overall electric power requirements of the plant brought about by the elimination of the electric motor driven chiller units allows the precooling gas turbine to economically power an electric generator in addition to the compression unit for the precooling refrigeration system. This electric generator can meet all the normal power requirements of the apparatus according to the invention and allows a substantial reduction in the investment required for separate gas turbine driven electric generators required in FIG. 1.

In a preferred embodiment, the natural gas discharged from the series of heat exchangers is fed to a nitrogen stripper column. The natural gas discharged from the series of heat exchangers may be fed to a heat exchanger within the stripper column, at or near the bottom of the stripper column, in order to provide reboil heat for the column; apart from this, it is preferred that the natural gas discharged from the series of heat exchangers is not subjected to any other heat exchange before being fed into the stripper column.

The stripper column generates a gaseous top product containing nitrogen and methane, and it is preferred that this top product is used as a fuel gas to power a turbine for driving the compression means for the refrigerant. The top product is preferably compressed in a fuel gas compressor before being fed to the turbine, and desirably the top product is not subjected to any heat exchange before being fed to the fuel gas compressor.

The arrangement of the stripper column, in accordance with the invention, makes it possible to use a cold box of a smaller size, and containing less equipment, than the cold box 181 in FIG. 1 (or even eliminate the cold box when the series of heat exchangers is provided in a single heat exchanger shell).

Furthermore, by feeding the top product directly to the fuel gas compressor, without any intermediate heat exchange, the suction temperature to the fuel gas compressor is lower, which reduces the power requirements and complexity. With the present invention, the fuel gas compressor may comprises a single compressor or two compressor stages with a single intercooler, and the power requirement can be reduced by up to about 50% compared with the compressor 180 in FIG. 1. Furthermore, an electric motor driven compressor may be used instead of the more expensive gas turbine.

The refrigerant is preferably nitrogen, and it is preferred that the refrigerant in the gaseous phase through the refrigerant cycle.

The relative flow rates of the first and second refrigerant streams can be controlled to match as closely as possible the natural gas cooling curve with the nitrogen warming curve. This is described in more detail in, for example, WO-A-9713108 and WO-A-9527179.

The apparatus according to the invention may be used in an offshore apparatus for liquefying natural gas, as described in WO-A-9713108. In this embodiment, the apparatus can be provided on a support structure (for example a ship) which is floatable or is otherwise adapted to support the apparatus at least partially above sea level.

With the arrangement of FIG. 1 a specific power of about 15.8 KW/tonne LNG produced/day is required. With the apparatus according to the invention a specific power of about 14.75 KW/tonne LNG produced/day is required. It will be appreciated that this is a significant power saving and is additional to the capital cost savings mentioned above.

BRIEF DESCRIPTION OF THE DRAWINGS

Reference is now made tot he accompanying drawings, in which.

DETAILED DESCRIPTION OF THE PREFERRED EMBODIMENTS

Figure 2:
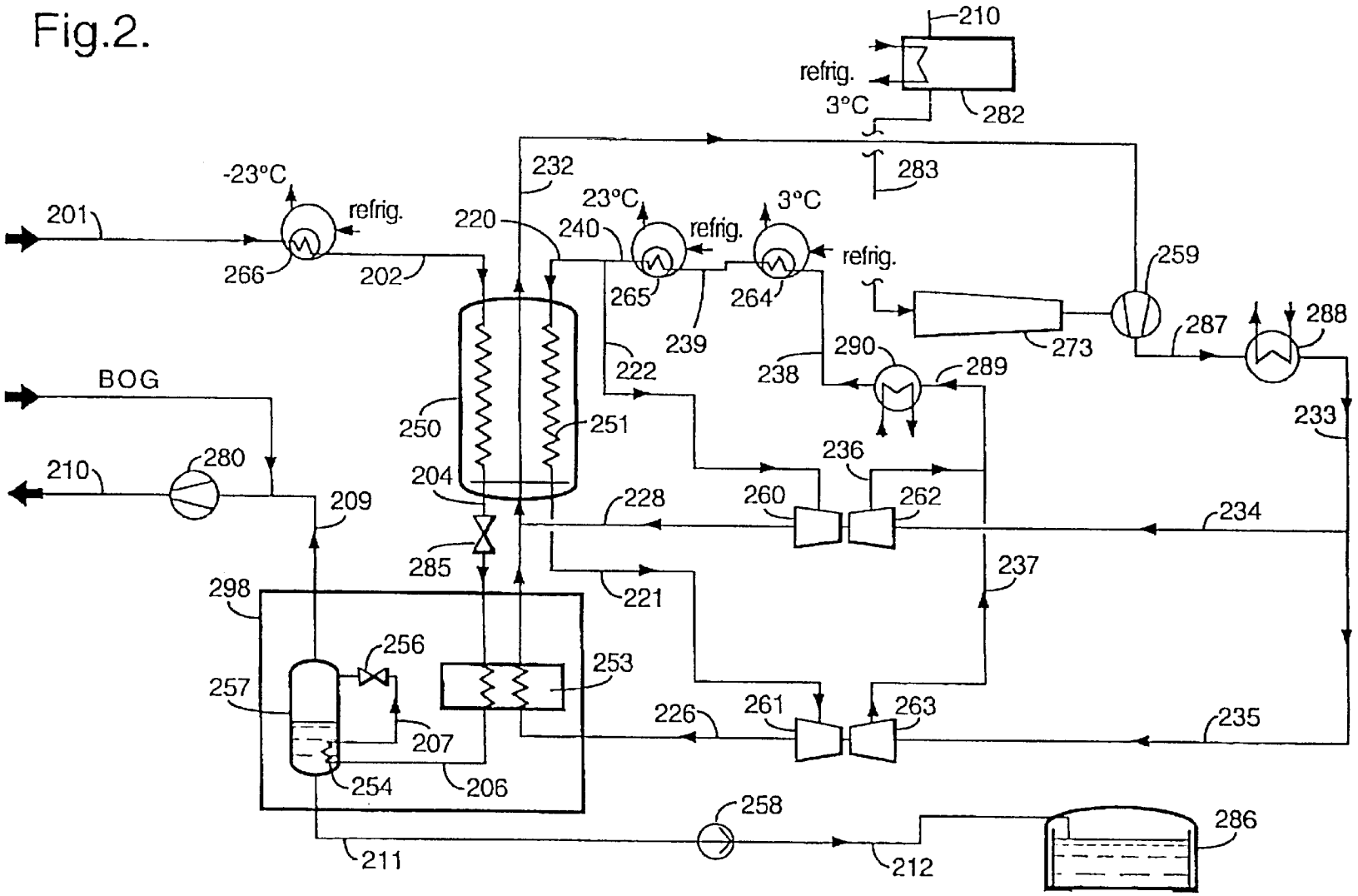
FIG. 2 is a schematic diagram showing one embodiment of an apparatus according to the invention.

In FIG. 2 pretreated natural gas is fed via a conduit 201 to a first precooling heat exchanger 266 at a pressure of about 8.3 MPa. In one example the natural gas in conduit 201 would have the following composition: 4.2 mol% nitrogen; 85.1 mol% methane; 8.2 mol% ethane; and 2.5 mol% propane. The heat exchanger 266 is a carbon steel kettle type chiller using R410a as a refrigerant. The natural gas in the conduit 201 is cooled to −19° C. in the heat exchanger 266, and is discharged into a conduit 202.

The natural gas exiting the heat exchanger 266 is fed to the warm end of a first heat exchanger 250 via the conduit 202. The heat exchanger 250 is a CWHE and comprises a single shell, which houses a single heat exchanger bundle 251. The natural gas is cooled in the heat exchanger 250 by countercurrent heat exchange with a nitrogen refrigerant. The cooled natural gas leaves the heat exchanger 250 at a temperature around −95° C. and is fed to a second heat exchanger 253 via a conduit 204. A throttle valve 285 is provided in the conduit 204, through which the natural gas can, optionally, be expanded. The natural gas is cooled to a temperature of about −152° C. in the heat exchanger 153, and exits the cool end of the exchanger 253 into a conduit 206.

The natural gas in conduit 206 is fed directly to a heat exchange arrangement 254 disposed within a nitrogen stripper column 257. The natural gas fed to the heat exchange arrangement 254 provides reboil heat at the bottom of the column 257, and is cooled by the natural gas at the bottom of the column 257. The natural gas is discharged from the heat exchange arrangement 254 into a conduit 207 through which the natural gas is fed to the top of the nitrogen stripper column 257. A throttle valve 256 is provided in the conduit 207, through which the natural gas can, optionally, be expanded.

LNG is discharged from the bottom of the column 257 into a conduit 211 and then to a pump 258. The pump 258 pumps the LNG into a conduit 212 and on to an LNG storage tank 286.

The flash gas, which contains methane and a high proportion of nitrogen, exits from the top end of the column 257 to a conduit 209. The flash gas in conduit 209, which is at a temperature of about −165° C., is fed to a fuel gas compressor 280. The compressor 280 is either a single stage compressor, or a two stage compressor with a single intercooler. The compressor 280 is driven by a 3MW electric motor. The flash gas is compressed in the compressor 280 from just above atmospheric pressure to a pressure which is typically in the range 2.7 to 5.5 MPa. High pressure fuel gas is discharged from the compressor 280 into a conduit 210. As described below, the methane-containing gas fed to the conduit 210 is used to provide the bulk of the fuel gas requirements of the liquefaction plant.

Figure 1:
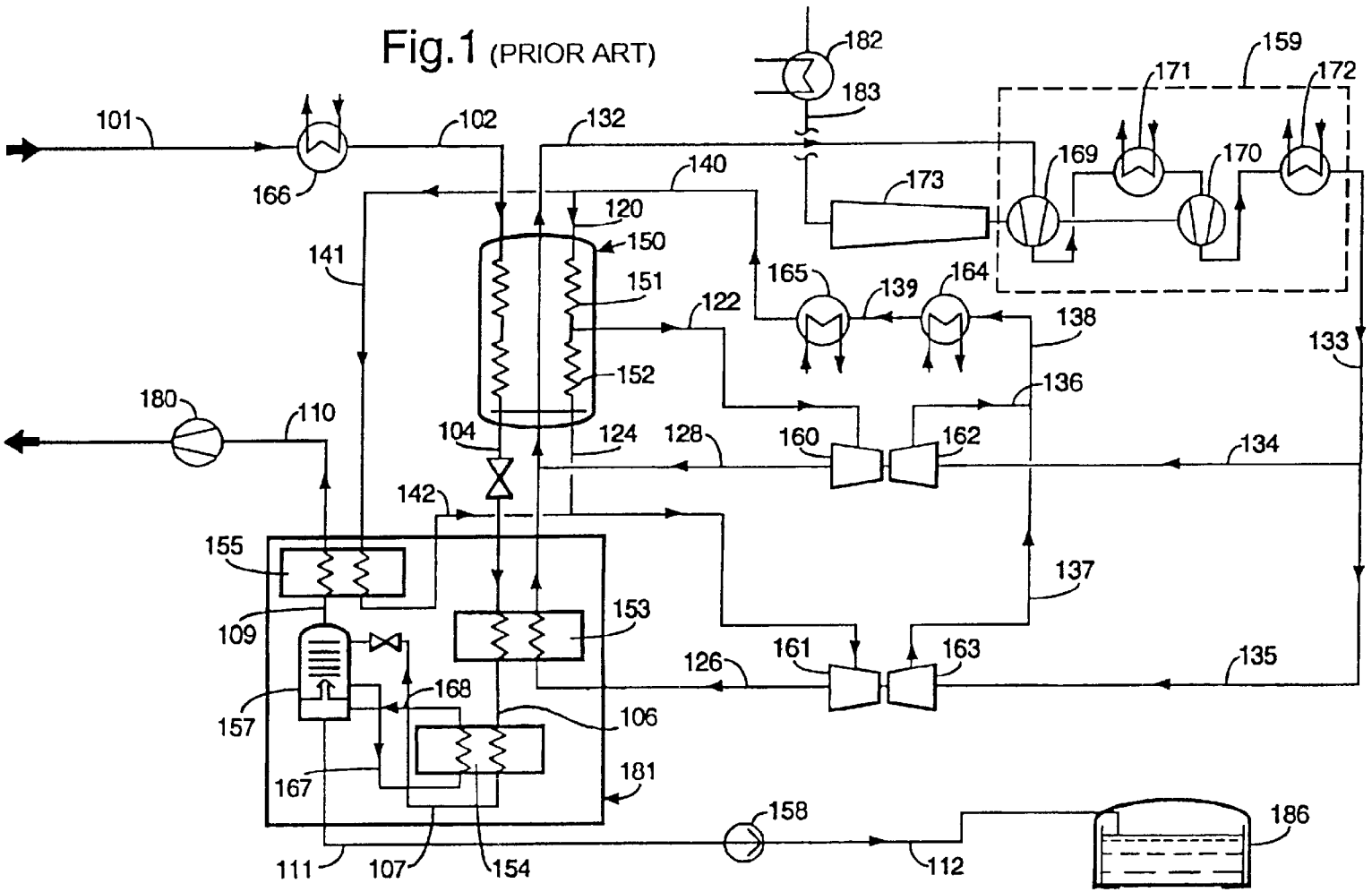
Fig. 1 (PRIOR ART)
FIG. 1 is a schematic diagram showing a natural gas liquefaction apparatus of the general type disclosed in WO-A-9713108.

The nitrogen refrigeration cycle which cools the natural gas to a temperature at which it can liquefy will now be described. Nitrogen refrigerant is discharged from the warm end of the heat exchanger 250 into a conduit 232 at a temperature of about −26° C. The nitrogen is fed to a single compressor stage 259; unlike the apparatus shown in FIG. 1, there is only one compressor stage, and, therefore, no intercooler is required. The compressor 259 is driven by a gas turbine 273 which may be an m Trent @ 54MW. The operation of the compressor 259 consumes almost all of the power required by the nitrogen refrigeration cycle.

The compressed nitrogen is discharged from the compressor 259 into a conduit 287 at a pressure of about 5.2 MPa. The nitrogen in the conduit 287 is fed to a heat exchanger 288, in which the compressed nitrogen is cooled to ambient temperatures by countercurrent heat exchange with sea water. The compressed nitrogen is discharged from the heat exchanger 288 into a conduit 233.

The conduit 233 leads to two conduits 234 and 235 between which the nitrogen from the conduit 233 is split according to the power absorbed by the compressor. The nitrogen in the conduit 234 is fed to a compressor 262 in which it is compressed to a pressure of about 8.5 MPa, and is then fed from the compressor 262 to a conduit 236. The nitrogen in the conduit 235 is fed to a compressor 263 in which it is compressed to a pressure of about 8.5 MPa. and is then fed from the compressor 263 to a conduit 237. The nitrogen in both the conduits 236 and 237 is fed to a conduit 289 and then to a heat exchanger 290, where it is cooled to ambient temperatures by countercurrent heat exchange with sea water.

The nitrogen is discharged from the heat exchanger 290 into a conduit 238 through which it is fed to a second precooling heat exchanger 264. The nitrogen is fed from the heat exchanger 264 through a conduit 239 to a third precooling heat exchanger 265. The heat exchangers 264 and 265 are similar to the heat exchanger 266, i.e., they are carbon shell kettle type chillers using R410a is a refrigerant. The compressed nitrogen is cooled to about 7° C. in the heat exchanger 264, and is cooled to about −19° C. in the heat exchanger 265.

The cooled compressed nitrogen is discharged from the exchanger 265 to a conduit 240, which leads to two conduits 220 and 222. The conduits 220 and 222 split the nitrogen into first and second refrigerant streams respectively. The conduit 220 is connected to the warm end of the heat exchanger 250. The nitrogen passing through the heat exchanger 250 is cooled to about −95° C. before being discharged into a conduit 221.

The nitrogen in the conduit 222 is fed to a turbo expander 260, in which it is work expanded to a pressure of about 1.9 MPa and a temperature of about −10° C. The expanded nitrogen is discharged from the expander 260 into a conduit 228. The nitrogen in the conduit 221 is fed to a turbo expander 261 in which it is work expanded to a pressure of about 1.9 MPa and a coolest nitrogen temperature of about −154° C. The expanded nitrogen is discharged from the expander 261 into a conduit 226. The turbo expander 260 is arranged to drive the compressor 262, and the trirbo expander 261 is arranged to drive the compressor 263. In this way the majority of the work produced by the expanders 260 and 261 can be recovered.

The nitrogen in the conduit 226 is fed to the cool end of the heat exchanger 253, and cools the natural gas in therein by countercurrent heat exchange. In the heat exchanger 253 the nitrogen is warmed to an intermediate nitrogen temperature of about −100° C. The nitrogen exits the warm end of the heat exchanger 253 and is mixed with the nitrogen in the conduit 228 before being fed to the cool end of the heat exchanger 250. The nitrogen in the heat exchanger 250 cools the natural gas therein by countercurrent heat exchange.

The heat exchanger 253, the throttle valve 256 and the column 257 are arranged within a cold box 298.

The gas turbine 273 is driven by the fuel gas derived from conduit 210. The combustion air for the turbine is fed to a fourth precooling heat exchanger 282, in which it is cooled to a temperature of about 10° C. Inlet air is discharged from the heat exchanger 282 into a conduit 283 which is connected to the air inlet of the turbine 273. The heat exchanger 282 is a finned tube exchanger using R410a as a refrigerant.

Figure 3:
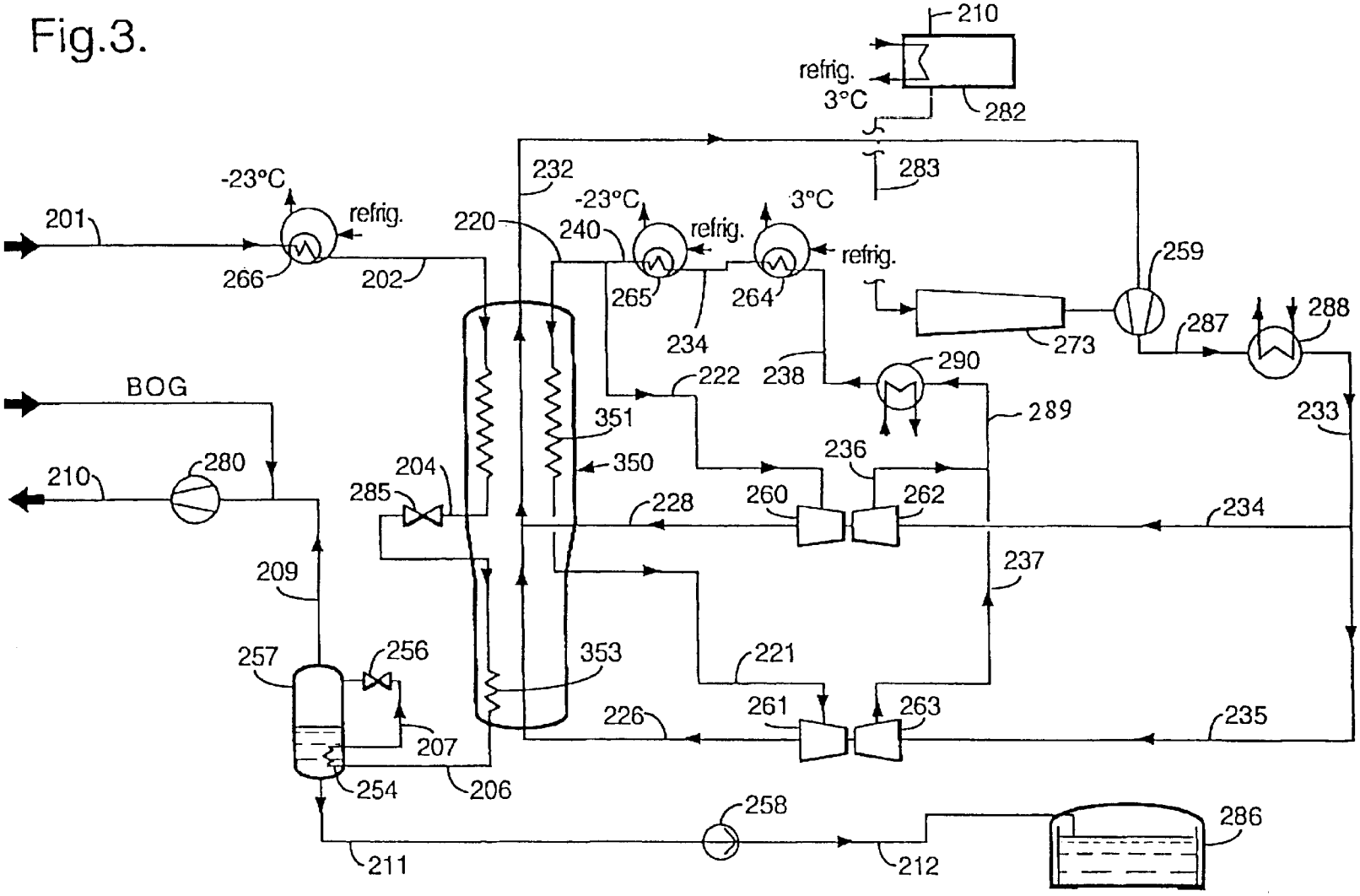
FIG. 3 is a schematic diagram showing another embodiment of an apparatus according to the invention.

FIG. 3 shows a modification of the apparatus shown in FIG. 2. Many of the parts shown in FIG. 3 are similar to the parts shown in FIG. 2 and like parts have been designated with like reference numerals.

The difference between the embodiments of FIGS. 2 and 3 are:

(i) The first and second heat exchangers 250 and 253 have been replaced with a single CWHE 350 comprising a shell housing first and second heat exchanger bundles 351 and 353.

(ii) The cold box 289 has been omitted.

Figure 4:
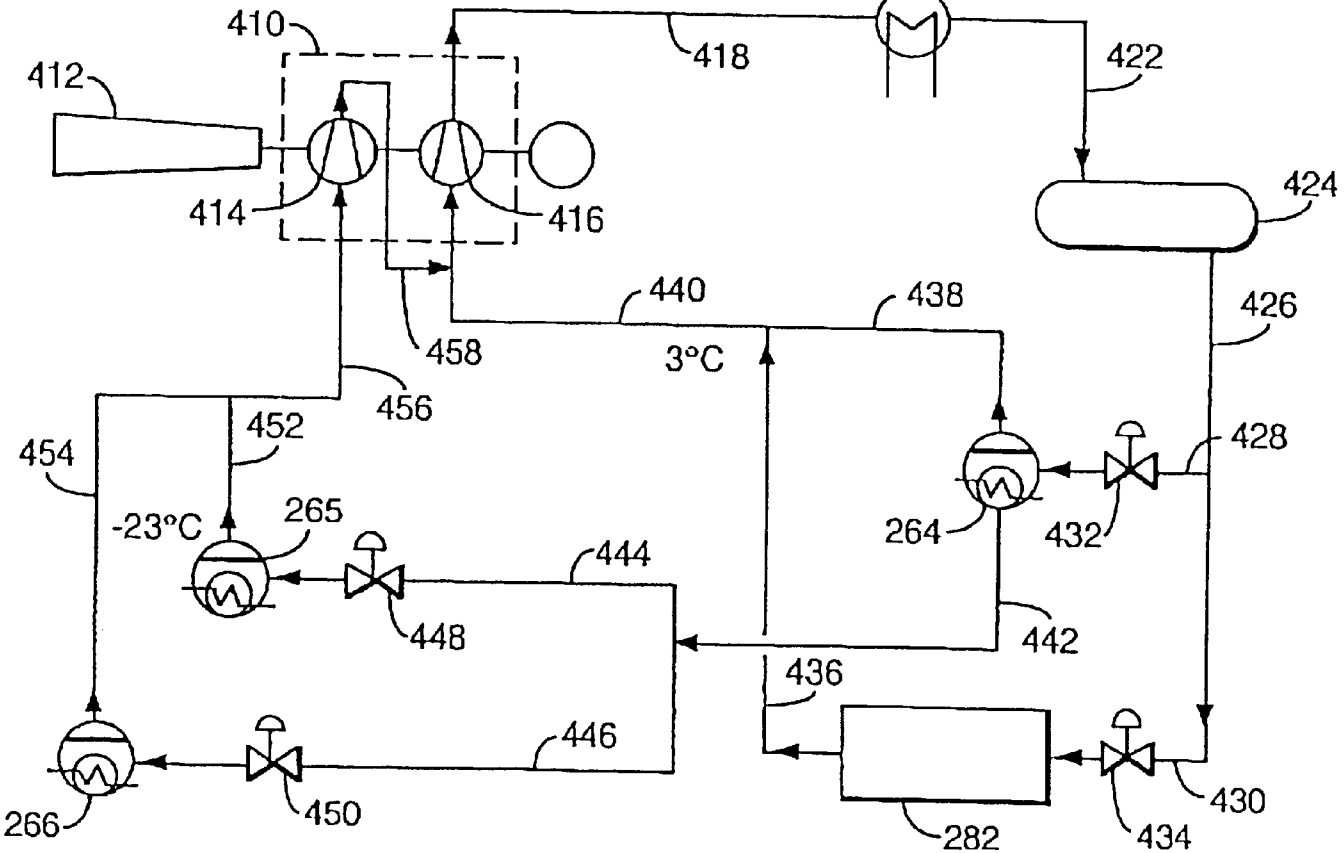
FIG. 4 is a schematic diagram showing an embodiment of a precooling refrigeration system for use with the embodiments of FIGS. 2 and 3.

FIG. 4. shows the precooling refrigeration system for the heat exchangers 264, 265, 266 and 282 providing refrigeration at −23° C. and 3° C. temperature levels. The heat exchangers 264, 265, 266 and 282 can be considered as first, second, third and fourth precooling heat exchangers respectively. The system includes a two stage, single case, API type refrigeration compressor unit 410 driven by a gas turbine 412. The compressor unit 410 has two compressor stages 414 and 416. In this example a two-stage refrigeration system is shown but it may be advantageous to use 3 or 4 stages for other situations. The precooling refrigerant is R410a, but other refrigerants may be used instead, including other Freons such as R134a. The turbine 412 also drives an electric generator G. which serves most of the electrical power requirements of the apparatus shown in FIGS. 2 and 3.

It will be appreciated that modifications may be made to the invention described above.

What is claimed is:

1. Apparatus for liquefying natural gas, comprising a series of heat exchangers for cooling the natural gas in countercurrent heat exchange relationship with a refrigerant, compression means for compressing the refrigerant, expansion means for isentropically expanding at least two separate streams of the compressed refrigerant, said expanded streams of refrigerant communicating with a cool end of a respective one of the heat exchangers, and a precooling refrigeration system for precooling the natural gas to a temperature below 0° C. before it is fed to the series of heat exchangers, and for precooling the compressed refrigerant discharged from a warm end of the series of heat exchangers to a temperature below 0° C. before it is fed back into the series of heat exchangers or to the expansion means, wherein a first of said separate refrigerant streams is cooled in at least one of the series of heat exchangers, and the precooling refrigeration system is arranged to pre-cool the refrigerant prior to cooling the first refrigerant stream in the series of heat exchangers, wherein precooled refrigerant in the or each refrigerant stream other than the first is fed directly to the expansion means without any further cooling, wherein the compression means comprises multiple compressors, and further comprising a stripper column containing a heat exchanger at or near the bottom thereof, the arrangement being such that the cooled natural gas discharged from the series of heat exchangers is fed to the stripper heat exchanger to provide reboil heat for the stripper, and is subsequently fed to the stripper.

2. Apparatus according to claim 1, wherein substantially all of the refrigerant discharged from said warm end of the series of heat exchangers is fed through the precooling refrigeration system.

3. Apparatus according to claim 1, wherein there are two heat exchangers in the series of heat exchangers, and the first refrigerant stream is cooled in a first, warmest, of said two heat exchangers.

4. Apparatus according to claim 1, wherein the precooling refrigeration system is arranged to precool the natural gas and the refrigerant to a temperature in the range −10° C. to −30° C.

5. Apparatus according to claim 1, wherein the precooling refrigeration system comprises a single compression unit having two or more compressor stages driven by a precooling gas turbine.

6. Apparatus according to claim 1, wherein the upper end of the stripper communicates with is a fuel gas inlet of a turbine for driving the refrigerant compression means, whereby the top product from the stripper fuels said turbine.

7. Apparatus according to claim 6, further comprising a compressor for compressing the top product from the stripper before it is fed to the fuel gas inlet, and wherein the precooling refrigeration system is arranged to precool the top product after it has been compressed.

8. Apparatus according to claim 1, wherein the series of heat exchangers are provided within a single heat exchanger shell having a number of heat exchanger bundles, each bundle corresponding to a respective one of the heat exchangers.

9. A method for liquefying natural gas comprising passing natural gas through a series of heat exchangers in countercurrent relationship with a refrigerant circulated through a work expansion cycle, said work expansion cycle comprising compressing the refrigerant, dividing and cooling the refrigerant to produce at least first and second cooled refrigerant streams, substantially isentropically expanding the first refrigerant stream to a first refrigerant temperature, substantially isentropically expanding the second refrigerant stream to a second refrigerant temperature warmer than first said refrigerant temperature, and delivering the refrigerant in the first and second refrigerant streams to a respective heat exchanger for cooling the natural gas through corresponding temperature ranges, wherein the natural gas is precooled in a precooling refrigeration system to a temperature below 0° C. before being fed to the series of heat exchangers, wherein the refrigerant discharged from a warm end of the series of heat exchangers is precooled in the precooling refrigeration system to a temperature below 0° C. after it has been compressed and before it is expanded or fed back into the series of heat exchangers, wherein a first of said refrigerant streams is cooled in at least one of the series of heat exchangers, and the precooling refrigeration system is arranged to precool the refrigerant prior to cooling the first refrigerant stream in the series of heat exchangers, wherein precooled refrigerant in the or each refrigerant stream, other than the first, is expanded in the work expansion cycle without any additional cooling, wherein the refrigerant is compressed in multi-stage compression, and wherein the refrigerant is nitrogen.

10. A method according to claim 9, wherein substantially all of the refrigerant discharged from said warm end of said series of heat exchangers is fed through the precooling refrigeration system.

11. A method according to claim 10, wherein there are two heat exchangers in the series of heat exchangers, and the first refrigerant stream is cooled in a first, warmest, of said two heat exchangers.

12. A method according to claim 9, wherein the refrigerant and natural gas is cooled by the precooling refrigeration system to a temperature in the range −10° C. to −30° C.

13. A method according to claim 9, wherein the natural gas discharged from the series of heat exchangers is fed to a heat exchanger disposed at or near the bottom of a stripper column, in order to provide reboil heat for the column, and is fed from the heat exchanger to the stripper column without any further heat exchange.

14. A method according to claim 13, wherein the gaseous top product from the stripper column is fed to a fuel gas inlet of a turbine for driving the compression of the refrigerant.

15. A method according to claim 14, wherein the top product is compressed, then cooled by the precooling refrigeration system, prior to being fed to the fuel gas inlet.

16. A method according to claim 15, wherein the top product is not subjected to any heat exchange cooling prior to being compressed.

17. An offshore natural gas liquefaction plant comprising an apparatus according to claim 1 and a support structure which is floatable or otherwise adapted to support the apparatus at least partially above sea level.

* * * * *